US006901702B2

(12) United States Patent
Liang et al.

(10) Patent No.: US 6,901,702 B2
(45) Date of Patent: Jun. 7, 2005

(54) BALANCE SHOE

(76) Inventors: Luke K. Liang, 13 Cordier St., Irvington, NJ (US) 07111; Tong Liang, 195 Yanjang Road Central, Suite 1712, Guangzhou, P.R. (CN), 510115

( * ) Notice: Subject to any disclaimer, the term of this patent is extended or adjusted under 35 U.S.C. 154(b) by 0 days.

(21) Appl. No.: 10/623,122

(22) Filed: Jul. 18, 2003

(65) Prior Publication Data

US 2005/0011128 A1 Jan. 20, 2005

(51) Int. Cl.[7] ..... E05D 15/22; E05D 13/00
(52) U.S. Cl. ..... 49/181; 49/176; 16/193
(58) Field of Search ..... 49/181, 176, 183, 49/445, 446, 463, 177, 161, 182, 453, 447; 16/193, 196, 197

(56) References Cited

U.S. PATENT DOCUMENTS 4,610,108 A * 9/1986 Marshik ..... 49/181
4,718,194 A * 1/1988 FitzGibbon et al. ..... 49/181
5,127,192 A * 7/1992 Cross ..... 49/181
5,243,783 A * 9/1993 Schmidt et al. ..... 49/181
5,301,467 A * 4/1994 Schmidt et al. ..... 49/181
5,697,188 A * 12/1997 Fullick et al. ..... 49/181
5,806,243 A * 9/1998 Prete et al. ..... 49/181
5,924,243 A * 7/1999 Polowinczak et al. ..... 49/181
6,058,653 A * 5/2000 Slocomb et al. ..... 49/181
6,119,398 A * 9/2000 Yates, Jr. ..... 49/181
6,161,335 A * 12/2000 Beard et al. ..... 49/181
6,658,794 B1 * 12/2003 Hansel et al. ..... 49/181
6,679,000 B2 * 1/2004 Uken et al. ..... 49/181

* cited by examiner

*Primary Examiner*—Hugh B. Thompson, II
(74) *Attorney, Agent, or Firm*—Thomas A. O'Rourke; Bodner & O'Rourke

(57) ABSTRACT

An improved balance shoe is described. There is a balance shoe housing, wherein there is a pivot member. The pivot member forces at least one side support member against the interior surfaces of a window jamb channel when said window is tilted. The pivot member comprises a base section having a top surface and a bottom surface, said top surface having at least one pivot member extending therefrom, said pivot member being adapted to force said support member against the interior surface of said window jamb as said pivot member is rotated due to the tilting of the window sash.

11 Claims, 5 Drawing Sheets

FIG. 1A
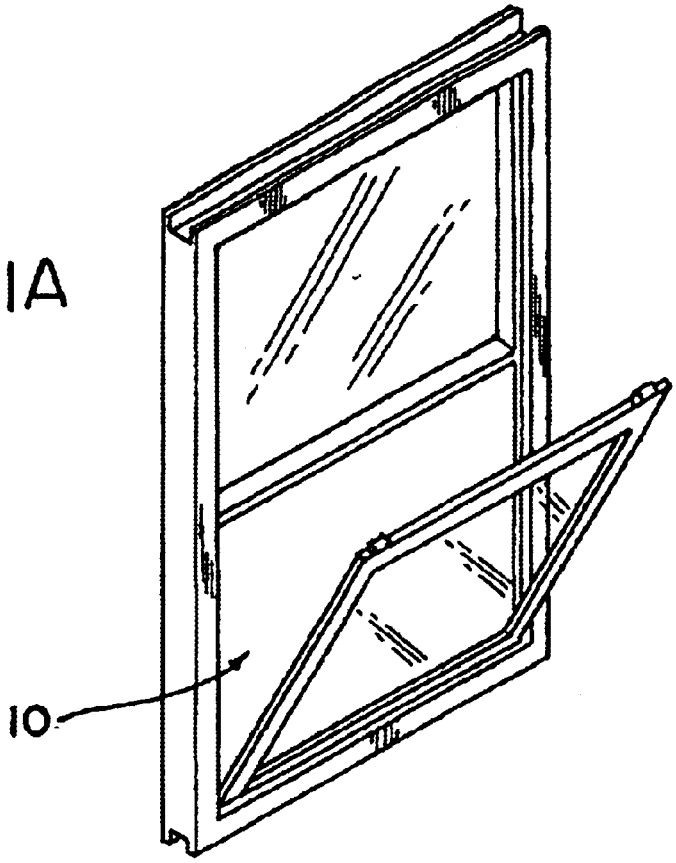
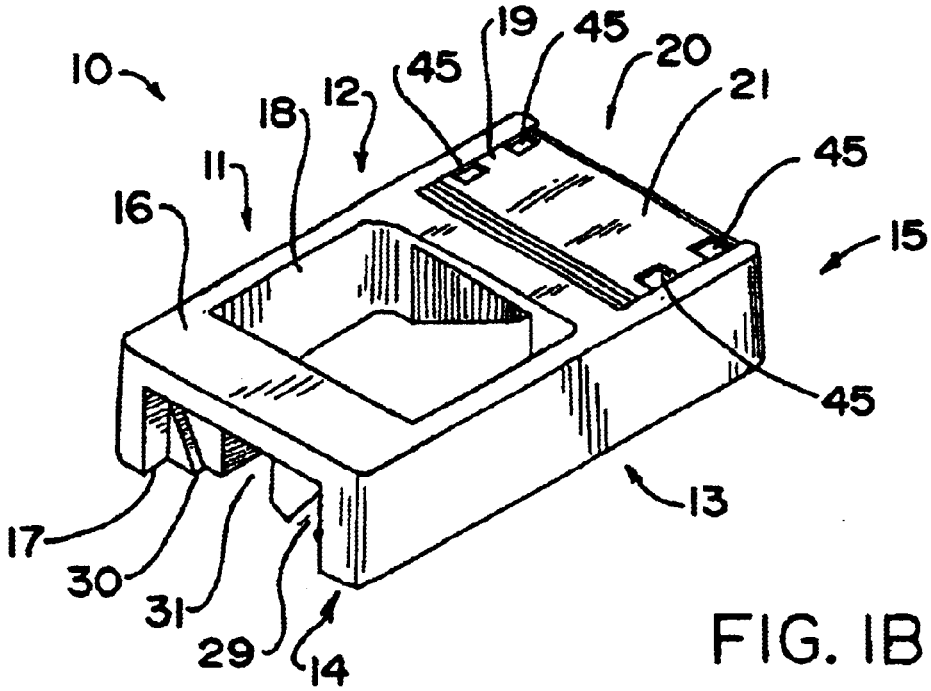
FIG. 1B

BALANCE SHOE

BACKGROUND OF THE INVENTION

Proper ventilation has become a necessity both at home and in the workplace. Most commonly, a homeowner will require proper ventilation when painting a room or finishing a floor within his or her home. Ventilation, especially the ability to allow for a cross-breeze within the work area, will alleviate the build-up of toxic fumes while allowing the paint or finish to dry quicker. Also, many homeowners install additional windows in their homes to provide a cooler climate in the house, rather than running an expensive air conditional through most of the day.

Factories and construction sites are also in need of proper ventilation. Factories may manufacture chemicals in extremely large quantities, and must prevent build-up of fumes to protect the health of the workers. Construction sites are most always filled with dust and debris, which if inhaled, can be extremely hazardous to a worker's health.

Many improvements in windows have occurred over the years, which have gone beyond simple vertical movement. Today, in addition to the traditional double hung windows there are a variety of different windows available. For example, windows can be opened along a vertical axis, similar to opening a door. Also, windows can be extended off their frames, similar to opening a hatch on a boat. One improvement to windows, particularly to double hung windows that has achieved wide acceptance is the tilt feature. Most of the improvements with the tilt feature in windows have made use of a mechanism in the channel of a window frame that allows the window sash to pivot, usually inwardly for cleaning purposes. Thus, the window can be tilted from the top or bottom depending where the pivotable sash is placed. Also, these devices have allowed users to maintain a window in a tilted position, if desired for ventilation purposes.

The use of a pivotable window sash has had many advantages. Windows can be easily replaced if the pane becomes cracked. The tilt feature permits the window to be readily removed from the sash is there is damage to the window. Also, because they are easily removable, the windows can be tilted inwardly or even taken out to be cleaned. Also, if necessary, a tilted window will increase the amount of air that flows in and out if necessary to air out a room that has a undesirable odor.

U.S. Pat. No. 4,610,108 discloses a device for maintaining a tilt-out window in a fixed position. However, the cam member which engages the window sash is very difficult to turn because of the great compressive force placed on it by the spring member. Also, the serrated portion of the spring member may strip the vinyl surface of the window channel if the window begins to slip, or force is placed on the window when it is in the tilted position.

One type of pivotable sash balance brake or shoe is shown in U.S. Pat. No. 5,371,971. This patent relates to a lock where the pivot pin extends outwardly from the window sash. The sash balance brake is disposed within a track in the window frame and includes a cam rotatably disposed within an expandable housing. The pivot pin has a collar for lateral engagement with the cam to prevent the window frame from bowing away from the window sash, thereby maintaining the window frame substantially square. The cam in this lock is disposed within an expandable housing. The pivot pin is received by the U-shaped cavity of the cam, such that rotation of the pivot pin upon pivoting of the sashes rotates the cam, thereby expanding the expandable housing to thereby lock the housing in its place and in its respective track. The cam also has a solid circular covering corresponding generally to the shape of a side housing opening, which is also substantially circular.

Another type of pivotable sash balance brake or shoe is found in Ashland's U.S. Pat. No. 5,806,243. In this patent the sash balance brake assembly comprises a rotor having a rotor camming surface and being rotatable about a rotor axis. A slider body is placed in one of the channels for coupling to one of the sash balance assemblies. The slider body includes means for rotatably supporting the rotor such that the camming surface is directed outwardly towards the respective outer wall. A bolt is provided having a bolt camming surface in operative engagement with the rotor camming surface, such that rotation of the rotor moves the bolt along the rotor axis and into engagement with the outer wall.

Other approaches are available for balance shoes to achieve the tilting function. These devices may include all metal shoes that are expensive to manufacture. Plastic shoes and shoes having a combination of metal and plastic can be problematical as the plastic parts are more prone to wear than the metal parts. As a result, there is a need for an improved balance shoe that is relatively inexpensive to manufacture and wherein the parts are capable of long life in use.

SUMMARY OF THE INVENTION

The present invention is directed toward a pivot-and-lock mechanism also known as a balance shoe, for tilt-out windows, primarily double hung windows. The shoe of the present invention has a locking take out and drop in feature. When the sash is tilted approximately 90 degrees the whole sash can be taken out of the frame and readily dropped back in since the cam is in an open position in that configuration. When the sash is returned to a generally vertical position within the window frame, the "T" shaped pivot bars are locked in the cam of the shoes. This prevents the window from bowing out during transportation. The "T" shaped bars also pull the window frame together through the cams of the shoe.

The pivot-and-lock mechanism comprises a balance shoe housing which is generally rectangular and is shaped to slide vertically with relative ease in a window frame channel. The window typically rides in a generally U-shapes channel, i.e., having a base section with a first end and a second end and two side sections extending from the same side of the base section. The balance shoe/housing uses a pivot member, which engages a pivot bar that is attached to a window sash. When the window is tilted, the pivot member rotates and forces a support plate into the inner surface of the window channel, more particularly, the base section of the U-shaped channel. The support plate is preferably made of the same material as the balance shoe, which is preferably a thermoplastic or another polymeric material that will allow for frictionless movement within the window channel, when the window is in a vertical position and raised and lowered.

The balance shoe also preferably houses a stability member which maintains the balance shoes' rectangular shape. The stability member, as well as the pivot member are preferably made of metal or another durable material that will have a greater stiffness than the balance shoe, and will not deform due to compressive force within the window channel nor rotation by the pivot bar.

BRIEF DESCRIPTION OF THE DRAWINGS

FIG. 1A is a perspective view of the present invention being used in a double hung window.

FIG. 1B is a top perspective view of the present invention.

DETAILED DESCRIPTION OF THE DRAWINGS

Figure 2:
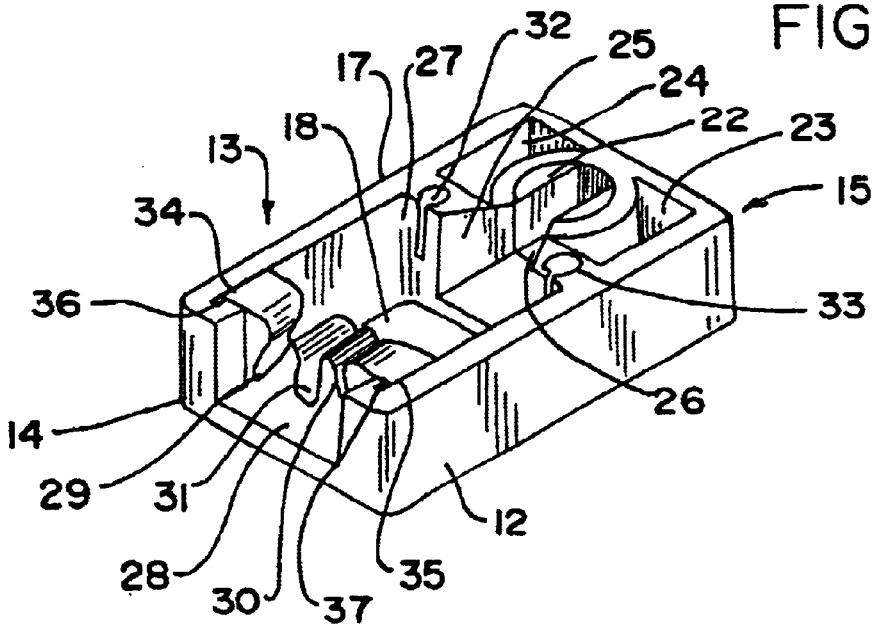
FIG. 2 is a bottom perspective view of the present invention.

The window or door assembly that may employ the balance shoe of the present invention may be a conventional double hung window. Also if modified the device can be used to tilt a single hung window, sliding window, sliding door and the like. For convenience the present invention will be described with reference to a double hung window but the same applies to each of the above other types of windows and doors having at least one sliding member that tilts. As seen in FIG. 1A, the double hung window usually includes upper and lower sash window frames, that are provided with suitable glazing to protect and bed the glass. The sashes are conventionally mounted within a main jamb frame for vertical reciprocal sliding movement therein. Sliding windows and doors are mounted for horizontal reciprocal sliding. Both the jamb frame and the sashes and can be formed of different materials, such as metal or strong and rigid plastics well known in this field. The sashes and are preferably fabricated from elongate framing members of hollow configuration and are generally rectangular in cross-section and rectilinear in configuration, but the shapes and configurations can vary. The upper sash includes a stile, and the lower sash includes a header having an upper exterior surface. The balance shoe of the present invention is designated generally in FIG. 1B by reference numeral 10.

As seen in FIG. 1B, the balance shoe 10 preferably has a generally rectangular balance shoe housing 11. Balance shoe housing 11 has a first side surface 12 and a second opposing side surface 13. It also has a top surface 14 and a bottom surface 15. It is noted that balance shoe housing 11 is preferably constructed out of a thermoplastic or other suitable polymeric material which will allow the balance shoe to slide easily in the channel of a window frame which holds the sashes. Additionally, the balance shoe housing may be any suitable shape that will fit within a window channel. Alternatively, the balance shoe housing may be made of wood, metal, or any other suitable material.

Balance shoe housing 11 also has an outer surface, i.e., front face 16 and an inner surface, i.e., rear face 17 that connect the first side surface 11 and the second side surface as well as the top surface 14 and bottom surface 15. The balance shoe housing 11 preferably has an opening on its front face 16 that extends at least partially through the shoe to the rear face 17. The opening is preferably a first generally rectangular hole 18. The balance shoe housing need not have hole 18, or it may be of any shape, size or depth. The opening is generally provided to reduce the weight of the shoe and thus, the cost of raw materials used in making the shoe. There is a second generally rectangular opening 19. This second opening 19 also extends through the device at least partially and has an open end 20 as well on bottom surface 15. The second opening 19 houses the support plate 21.

As seen in FIG. 2, pivot member 22 is located beneath support plate 21. Cast cut-outs 23 and 24 surround pivot member 22. Rectangular opening 18 has diagonal guides 25 and 26 coming off of its bottom edge 27. The diagonal guides allow the head of the pivot bar (not shown) to slide easily into and out of the pivot member 22. Also, incorporated into balance shoe 11 is a removable stability member 28. Stability member 28, as well as pivot member 22, are preferably made of metal or other durable material. The stability member 28 should be able to resist compressive forces within the window channel due to house settling or other force on the window frame. The pivot member 22 must be able to resist wear caused by rotation of the pivot bar as the sash is tilted from time to time during use. Stability member 28 fits between the upper portions of side surfaces 12 and 13.

Stability member 28 is generally rectangular in shape with a first diagonal slot 29 and a second diagonal slot 30 separated by a middle slot 31. The slots allow the balance shoe housing 11 to conform to deformable window channels, while maintaining the overall rectangular shape of the balance shoe. Stability member 28 may be retained in position in the balance shoe 11 by use of a first side flange 34 and a second side flange 35. Side flange 34 slides into slot 36 and side flange 35 slides into slot 37. Side surfaces 12 and 13 are preferably slightly angled toward each other to allow stability member 28 to fit tightly into the balance shoe housing 11. It is understood that the stability member may be eliminated or machined without slots or be provided with additional slots. Also, along inner surface 17 may be circular cast holes 32 and 33.

Figure 3:
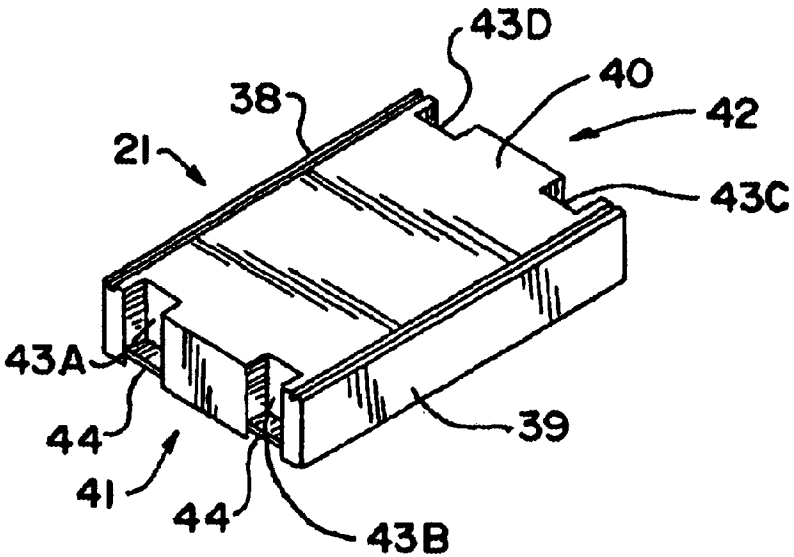
FIG. 3 is a top perspective view of the support plate of the device in FIG. 1.
Figure 4:
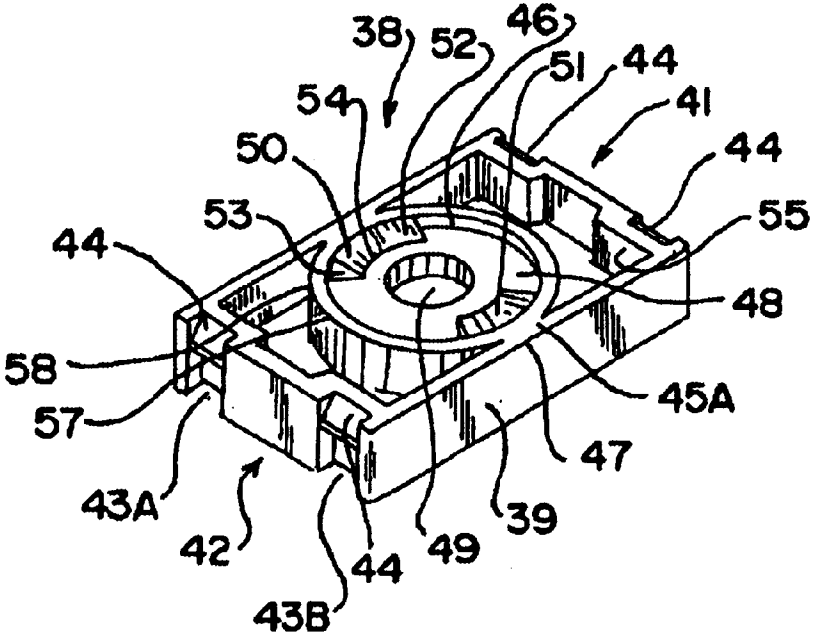
FIG. 4 is a bottom perspective view of the support plate of the device in FIG. 1.

Support plate 21 is better seen in FIGS. 3 and 4. Support plate 21 is preferably rectangular with upper edge 38 and lower edge 39. Any shape may be used for the support plate. A rectangular shape can provide the support plate with a large amount of contact area when it is pressed into the surface of the window channel. Also, support plate 21 is preferably made out of the same material as balance shoe 11. The outer surface 40 of the support plate will be raised by the pivot member and press against the inner surface of the window channel when the window sash is pivoted. It will be appreciated that the window channel has a inner surface and two opposing side surfaces extending upwardly from the inner surface, Thus, the channel is generally U-shaped and permits the window sash to travel and be retained therein.

Along the side surfaces 41 and 42 of the support plate 21 are rectangular cut-outs. Preferably, there are four rectangular cut-outs 43 (A–D) as seen in FIG. 3. At the bottom of each cut-out 43 is a retaining flange 44. When the support plate is extended due to rotation of the pivot member, the support plate will not extend passed a given point, because each retaining flange 44 will come in contact with a small retaining wall 45 which is part of the outer surface 16 of the balance shoe housing 11. The small retaining walls extend a short distance inwardly along the outer surface 16. The small retaining walls 45 can be seen in FIG. 1. It is understood that there may be any number of retaining flanges as long as it corresponds to the number of retaining walls. This function extending the support plate may be accomplished by any method that will allow the support plate to travel a fixed distance away from the outer surface of the balance show housing.

Figure 7B:
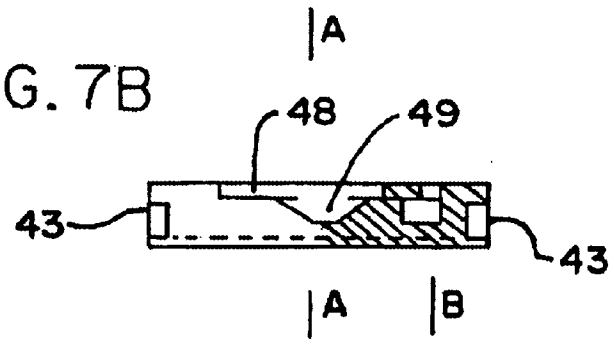
FIG. 7B is a cross-sectional view of the support plate in FIG. 7A.
Figure 7C:
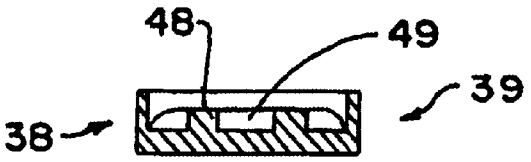
FIG. 7C is a cross-sectional view of the support plate in FIG. 7B along line A—A.
Figure 7:
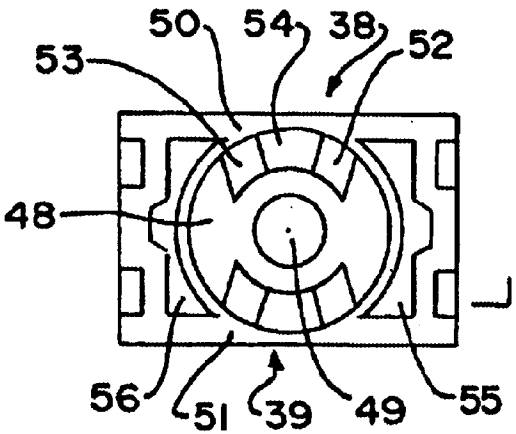
FIG. 7 is a bottom view of the support plate of the device in FIG. 1.
Figure 7A:
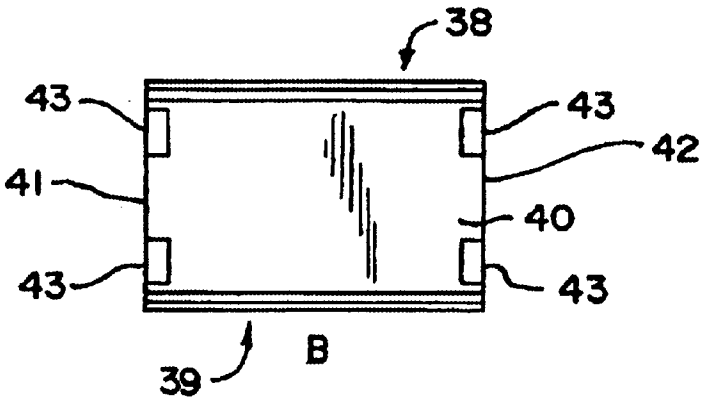
FIG. 7A is a top view of the support plate of the device in FIG. 1.

As seen in FIGS. 4 and 7 the inner surface 45A of support plate 21 has a circular cut-out in its center portion 47. The circular cut-out 46 has an inset flat portion 48 with an orifice or recess 49 in its center. Orifice 49 preferably does not pierce the outer surface 40 of the support plate. Cut into the flat portion 48 of cut-out 46 is a first engagement portion 50 and a second engagement portion 51. Each engagement portion is comprised of a first diagonal portion 52, a second diagonal portion 53, and a flat portion 54 in between them. Obviously, each engagement portions need not be comprised of flat surfaces, as they may be rounded or triangular.

Also, cut into the inner surface 45 of support plate 21 are insets 55 and 56. Each inset has an arcuate inner edge 57 and a flat outer edge 58. Insets 55 and 56 preferably do not pierce the outer surface 40 of the support plate 21. One may allow hole 49 and insets 55 and 56 to pierce outer surface 40, however, that would decrease the contact area between the support plate 21 and the inner surface of the window channel. Thus, the window could be less stable in the window channel.

Figure 5:
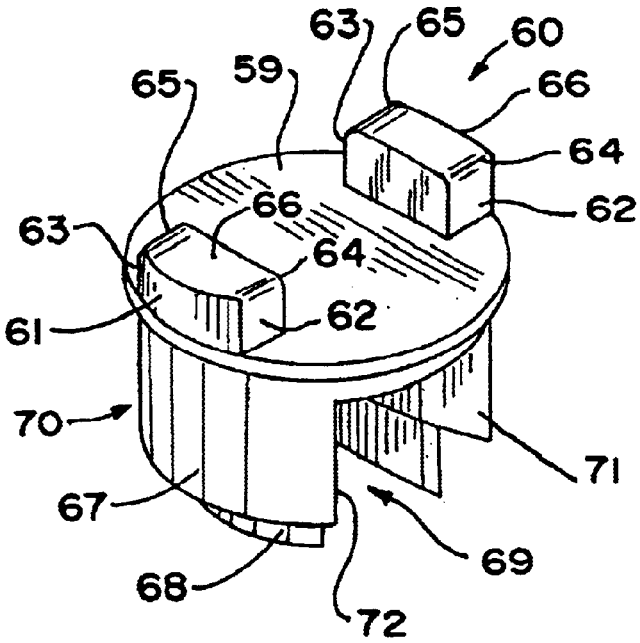
FIG. 5 is a top perspective view of the pivot member of the device in FIG. 1.

FIG. 5 shows pivot member 22. Pivot member 22 is preferably made of metal such as cast aluminum or another durable material. Pivot member 22 is generally circular with a flat upper portion 59. Upper portion 59 has a first raised member 60 and a second raised member 61. Each raised member may have flat side surfaces 62 and 63, rounded upper corners 64 and 65, and a flat upper surface 66.

When the window is set in a vertical position within the frame, the raised members 60 and 61 fit into engagement portions 50 and 51 of the inner surface 45 of the support plate 21. When the window is pivoted along its sash, the pivot member 22 turns within the balance shoe housing 11 and forces the raised members 60 and 61 out of the engagement portions 50 and 51; thus, extending the support plate 21 away from the outer surface of balance shoe housing 11 and into contact with the inner surface of the window channel. The compressive force between the support plate and the window channel surface can maintain the window in a tilted position away from the frame.

Pivot member 22 has a generally circular middle portion 67 and a generally circular lower portion 68. A generally rectangular opening 69 is cut completely through middle portion 67, and up to the outer back edge 70 of the lower portion 68. The rectangular opening 69 receives a pivot bar (not shown) that is present in a window sash (not shown). The T-shaped head of the pivot bar is placed in the pivot member 22, and is locked into place when the window is tilted because the hole 69 receives the entire T-shaped head.

The middle portion 67 and lower portion 68 have diagonal cuts 71 and 72 at the opening of hole 69. The diagonal cuts allow the window's pivot bar to be easily put in place within the pivot member 22 for replacement or after cleaning. Diagonal cuts 71 and 72 align with diagonal guides 25 and 26 on the balance shoe housing 11.

Figures 6A, 6B, 6C:
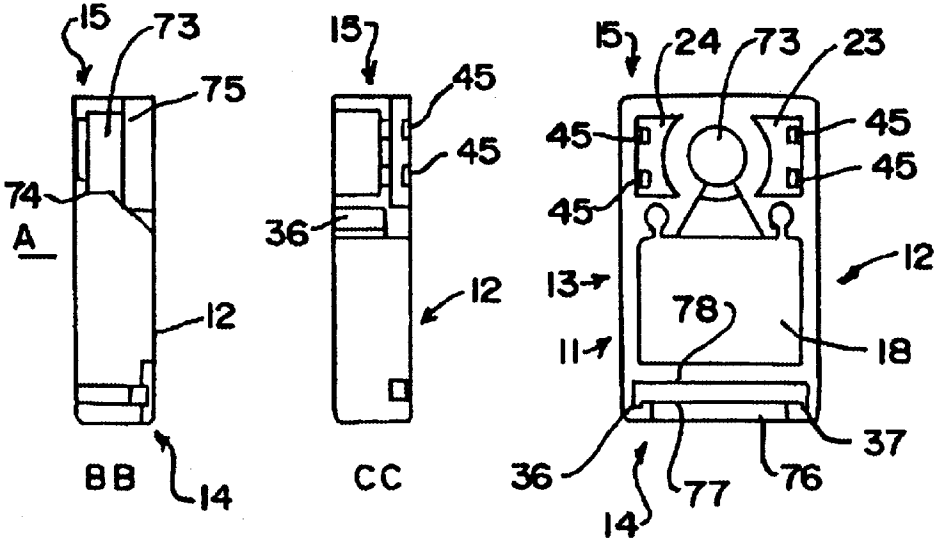
FIG. 6A is a cross-sectional view of the balance shoe of FIG. 6 along the line B—B.
FIG. 6B is a cross-sectional view of the balance shoe of FIG. 6 along the line C—C.
FIG. 6C is a bottom view of the balance shoe of the present invention.
Figure 6:
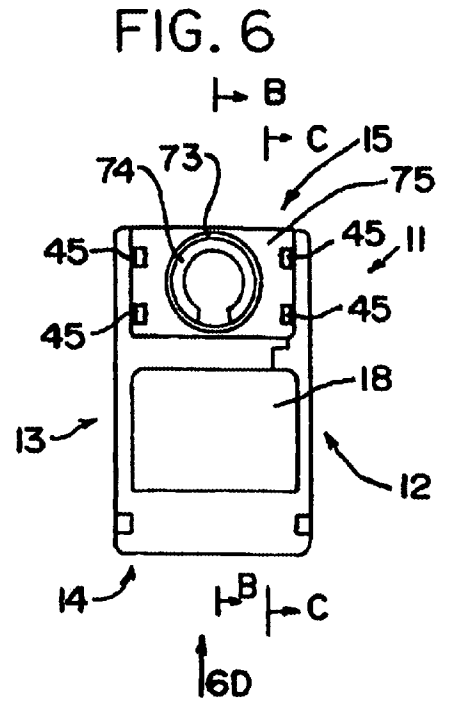
FIG. 6 is a top view of the balance shoe of the present invention.
Figure 6D:
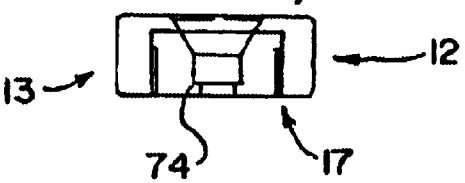
FIG. 6D is a side view of the top surface of the balance shoe of FIG. 6.

As seen in FIG. 6, the balance shoe housing 11 has a circular cut-out 73 towards its bottom portion. When the pivot member 22 is placed in circular cut-out 73, the bottom of middle portion 67 of the pivot member rests on ledge 74. The lower portion 68 of the pivot member will be flush with the inner surface 17 of the balance shoe housing 11. Also, the flat upper portion 59 is in the same plane as flat surface 75, with raised members 60 and 61 extending outward.

FIG. 6C clearly depicts the receiving means 76 of the balance shoe housing 1 for the stability member 28. Slots 36 and 37 are cut into the balance shoe housing 11 for receiving side flanges 34 and 35 of the stability member. Deep ledge 77 articulates with a lower portion of the stability member, while shallow ledge 78 articulates with a higher portion of the stability member. When the stability member is in place, all of its sides except the side with slots 29, 30 and 31 are generally completely in contact with the balance shoe housing 11.

We claim:

1. A balance shoe comprising a balance shoe housing, shaped to move in a window frame channel, the window channel having at least a base section and two side sections extending from the base section, said balance shoe housing having pivot member, which is adapted to engage a pivot bar that is attached to a window sash such that when a window is tilted, the pivot member rotates and forces a support plate against the base section of the window channel, said pivot member being generally circular with a flat upper portion said upper portion having a first raised member and a second raised member, said first and second raised members contacting first and second recessed engagement portions on an underside of the support plate, said engagement portions of said support plate comprising a first diagonal portion, a second diagonal portion, and a flat portion in between said diagonal portions, said first and second raised members extending said support plate outwardly when said pivot member is rotated and said first and second-raised members are no longer contacting said recessed portions.

2. The balance shoe of claim 1 wherein said pivot member has an oval shaped head portion, a circular middle portion, and a circular lower portion.

3. The balance shoe of claim 1 wherein the balance shoe housing uses a stability member to prevent the balance shoe from deforming due to compressive force in the window channel.

4. The balance shoe of claim 3 wherein said stability member has at least one slot which will allow for minimal deformation due to compressive force.

5. The balance shoe of claim 4 wherein said stability member is made of metal.

6. The balance shoe of claim 5 wherein the stability member fits between a side surfaces of said balance shoe housing.

7. The balance shoe according to claim 1 wherein said pivot member has a generally circular middle portion and a generally circular lower portion.

8. The balance shoe according to claim 7 wherein there is a generally rectangular opening cut completely through said middle portion, and up to an outer back edge of the lower portion.

9. The balance shoe according to claim 8 wherein the middle portion and lower portion have diagonal cuts at said opening.

10. The balance shoe according to claim 1 wherein said pivot member has a flat upper surface that comprises a major portion of the upper portion of said pivot member.

11. The balance shoe according to claim 1 wherein said first raised member and said second raised member have flat side surfaces, rounded upper corners, and a flat upper surface.

* * * * *